US006446963B1

(12) United States Patent
Dadbeh

(10) Patent No.: US 6,446,963 B1
(45) Date of Patent: Sep. 10, 2002

(54) PLAYING FIGURE FOR TABLE SOCCER

(75) Inventor: Bemanali H. Dadbeh, Encinitas, CA (US)

(73) Assignee: Escalade, Incorporated, Evansville, IN (US)

( * ) Notice: Subject to any disclaimer, the term of this patent is extended or adjusted under 35 U.S.C. 154(b) by 0 days.

(21) Appl. No.: 09/738,470

(22) Filed: Dec. 18, 2000

(51) Int. Cl.[7] ..... A63F 7/06
(52) U.S. Cl. ..... 273/108.52; 273/108.54
(58) Field of Search ..... 473/108, 108.1, 473/108.5, 108.51, 108.52, 108.53, 108.54, 108.55, 108.56, 108.57, 129 R, 129 W

(56) References Cited

U.S. PATENT DOCUMENTS 4,307,884 A * 12/1981 Remmler
5,333,864 A * 8/1994 McCloud
5,377,981 A * 1/1995 Monneret
5,419,555 A * 5/1995 McCloud

FOREIGN PATENT DOCUMENTS

EP 000500476 * 8/1992 ..... 273/85 D
FR 985312 * 7/1951 ..... 273/85 D

* cited by examiner

*Primary Examiner*—Sebastiano Passaniti
(74) *Attorney, Agent, or Firm*—Irving Keschner

(57) ABSTRACT

An improved table soccer playing figure wherein the foot portion thereof is formed of a flexible material such as polyesopreme, polyeurathane or hard rubber. A metal support rod couples the foot portion to the body portion and provides strength and support to the foot. allowing the player to deliver impact to the ball without losing energy because of the foot flexibility. A weight is added to the figure head portion to balance the playing figure symmetrically around the support rod.

6 Claims, 2 Drawing Sheets

FIG. 1
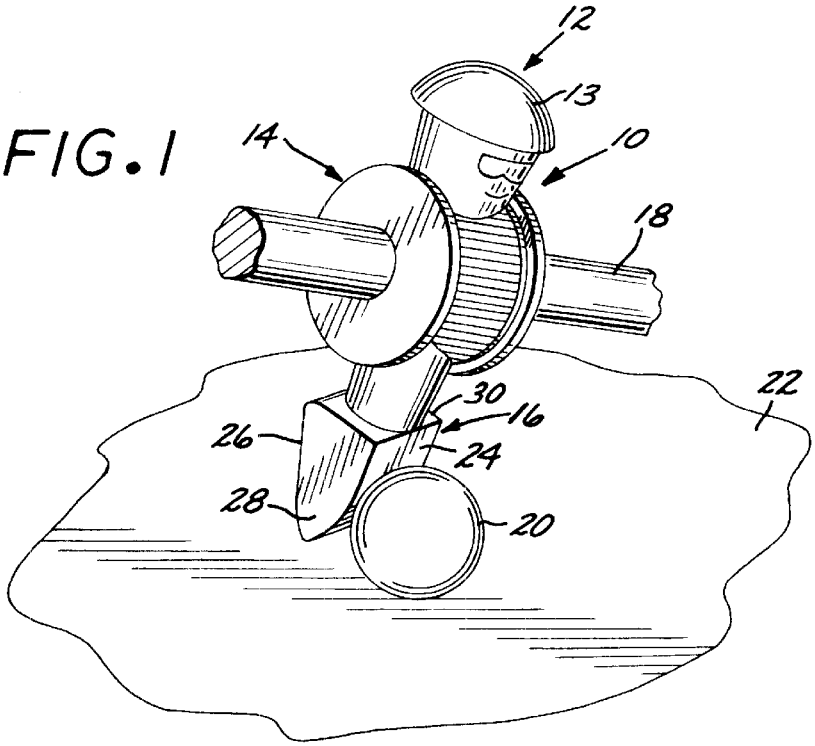
FIG. 2
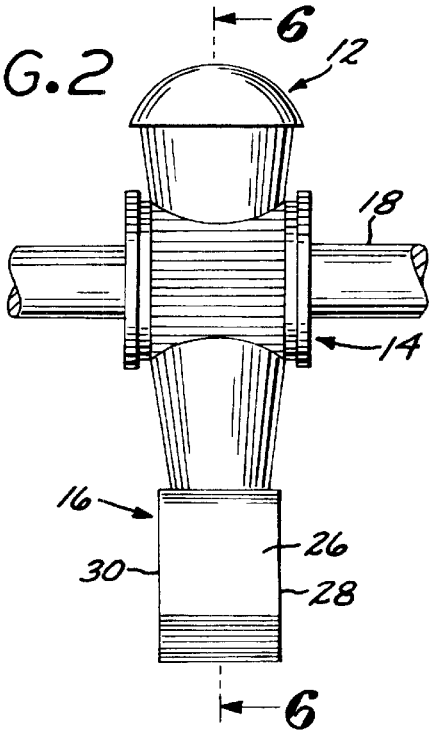
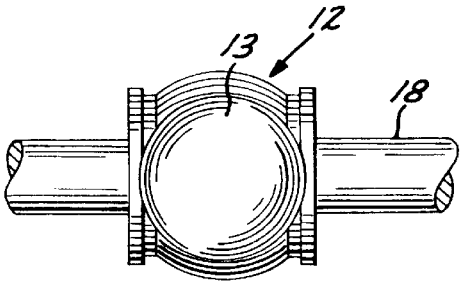
FIG. 3
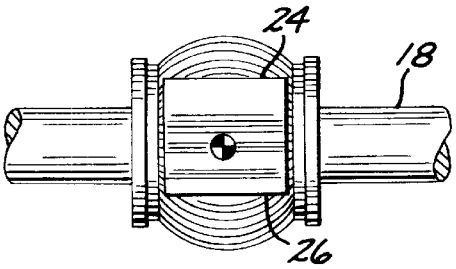
FIG. 4

PLAYING FIGURE FOR TABLE SOCCER

BACKGROUND OF THE INVENTION

1. Field of the Invention

The present invention provides a playing figure for use in a table soccer game.

2. Description of the Present Invention

The game of fussball or table soccer is a popular game for recreation centers, taverns as well as homes. Typically, playing figures having a foot portion are mounted on a rod controlled by a player. When a ball is entered into the play area, a player manipulates the rod which in turn controls the foot portion as it comes into contact with the ball. Devotees of the game have developed significant expertise in maneuvering and manipulating the game ball motion to overpower their opponent. Among the activities and control are actions such as trapping the ball, ricocheting the ball for a predetermined duration, etc. In order to satisfy the demands of the game, many innovations have been produced, such as providing an improved playing figure such as that disclosed in U.S. Pat. No. 5,333,864 to McCloud. The McCloud playing figure has a knurled or textured surface on the front and back of the foot thus causing friction and a grabbing effect on the ball. However, the sides of the foot, used by experts in the course of the game, are not designed to provide additional control of the playing ball.

What is thus desired is to provide a table soccer paying figure which has a foot portion modified to provide an additional capability for controlling the game ball.

SUMMARY OF THE PRESENT INVENTION

The present invention provides an improved table soccer playing figure wherein the foot thereof is formed of a hard, flexible material to provide players with additional capabilities for controlling the forces applied to the game ball.

In particular, the playing figure comprises a foot portion having four surfaces fabricated from a hard, flexible material such as hard rubber, polyesopreme or polyeurathane. The four surfaces enable a player to apply English and other motion manipulations to the ball. A metal support rod within the playing figure provides strength and support to the foot portion, enabling the player to deliver impact to the ball with minimum energy loss because of foot flexibility. A weight is added to the figure head to balance the playing figure symmetrically about the support rod.

The present invention thus provides a soccer playing figure having an improved foot portion which enables a player to further manipulate and control the playing bell.

DESCRIPTION OF THE DRAWINGS

For a better understanding of the invention as well as other objects and further features thereof, reference is made to the following description which is to be read in conjunction with the accompanying drawings herein:

FIG. 1 illustrates the table soccer playing figure of the present invention mounted on the actuation rod;

FIG. 2 is a rear view of the soccer playing figure shown in FIG. 1;

FIG. 3 is a top view of the playing game figure shown in FIG. 1;

FIG. 4 is a bottom view of the playing game figure shown in FIG. 1;

DESCRIPTION OF THE INVENTION

Figure 5:
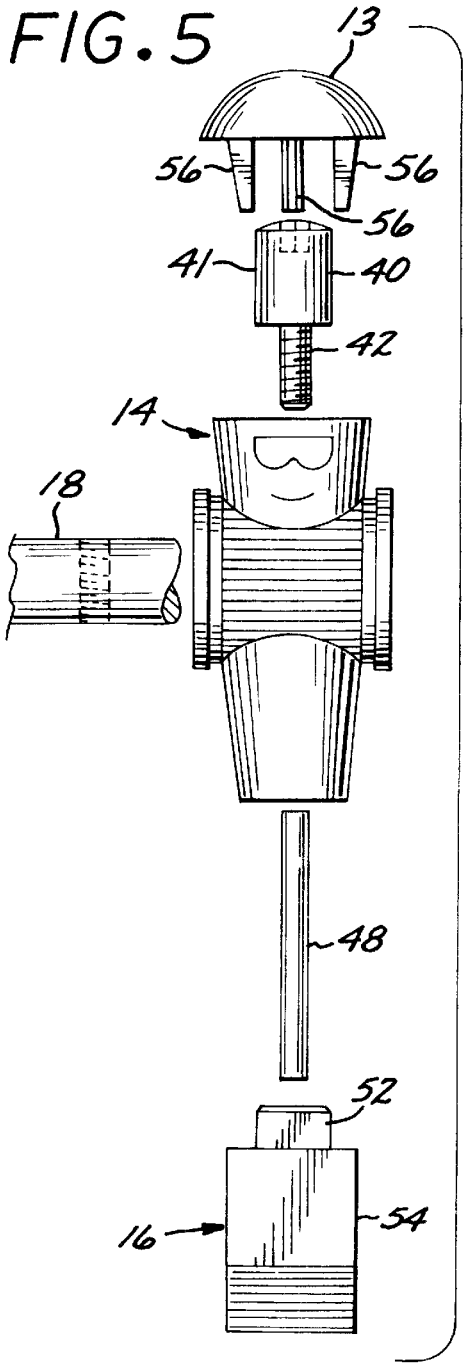
FIG. 5 is an exploded view of the playing game figure shown in FIG. 1.

The present invention relates to playing figures for use in table soccer (known also as fussball) game structures and specifically to a playing figure having an improved foot portion for better control and manipulation of a playing ball. The details of the game itself, including the axially slidable and rotatable actuating rods, will not be set forth for purposes of brevity since the components are conventional and well known.

Referring now to FIGS. 1–4, the playing figure 10 of the present invention comprises head portion 12, body portion 14, foot portion 16, and actuating rod 18. A playing ball 20 is shown resting on playing surface 22. Improved foot portion 16 comprises front surface 24, rear surface 26 and side surfaces 28 and 30.

FIG. 5 illustrates the basic components that comprise playing figure 10. In particular, playing figure 10 comprises head portion 12, a metal weight member 40 having a recessed head portion 41 and threaded shank portion 42, body portion 14 having an opening 46 for receiving shank portion 42 (FIG. 6), actuating rod 18, metal support rod 48 and foot portion 16. Body portion 14 has an opening 50 for receiving transverse actuating rod 18 and foot portion 16 includes a protrusion, or extension, 52 formed on the top of the foot body 54 as illustrated. Head portion 12 includes a decorative hat 13 having a plurality of prong members 56 extending downwardly therefrom as illustrated.

Figure 6:
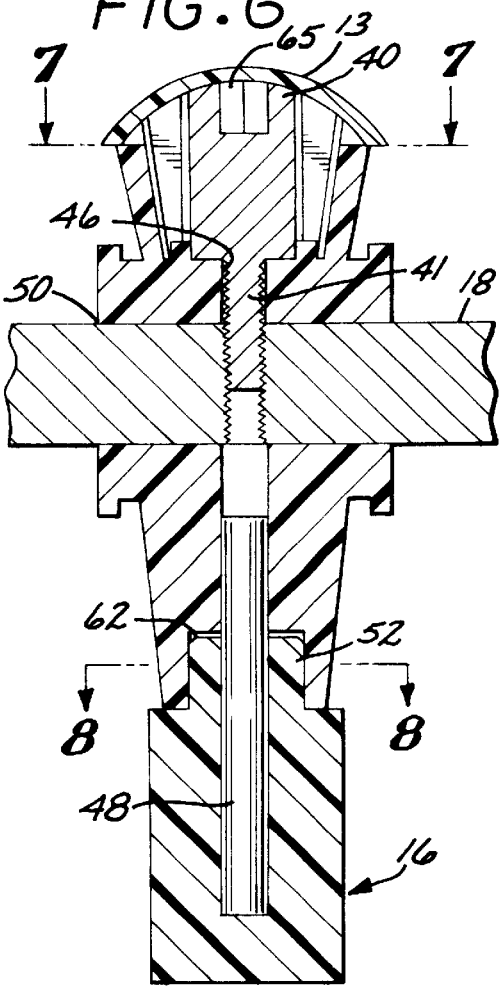
FIG. 6 is a cross-sectional view along line 6—6 of FIG. 2.
Figure 7:
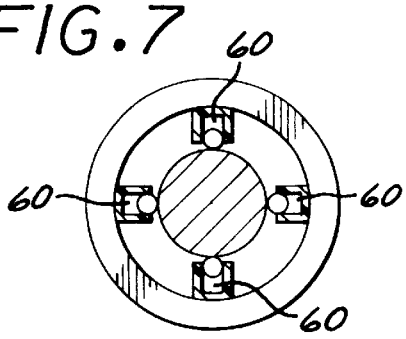
FIG. 7 is a cross-sectional view along line 7—7 of FIG. 6.
Figure 8:
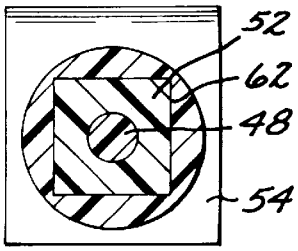
FIG. 8 is a cross-sectional view along line 8—8 of FIG. 6.

FIG. 6 illustrates the components shown in FIG. 5 assembled to form the complete playing figure 10. As shown, shank portion 42 of weight member 40 is first secured in coaligned threaded openings formed in body portion 14 and actuating rod 18. Prong members 56 of hat 13 are then inserted into corresponding receptacles 60 formed in the top of body portion 14 as illustrated in FIG. 7. Metal insert rod 48 has one end positioned in an opening formed in the bottom portion of body portion 14, the other end of insert rod 48 extending into an opening formed in foot portion 16 as illustrated. Protrusion 52 of foot portion 16 extends into a recess 62 formed in the bottom portion of foot portion 16 (FIG. 8).

Head portion 41 has a driver recess 65 formed therein enabling the assembler to insert the weight member 40 into the threaded coaligned recesses, or openings, formed in body portion 14 and actuation rod 18. Weight member 40 balances playing figure 10 symmetrically around actuation rod 18.

Metal support rod, or insert, 48 provides strength and support to foot portion 16, enabling a player to deliver impact to the ball 20 without losing energy because of the flexibility designed into foot portion 14.

As illustrated, foot rear surface 26 is substantially flat and front surface 24 radiused.

Foot portion 16, support rod 48 and body portion 14 are permanently joined together by adhesive. Foot portion 16 is fabricated from a limited flexible material, such as hard rubber, polyesopreme or polyeurathane (in essence, most plastic materials available can be used with the exception of Teflon® and its derivatives). The use of this material allows all four surface portions to have friction capabilities between the foot surface and ball 20 and thus to function in a manner similar to a chalked cue tip against a cue ball. In particular, the flexible foot portion material allows the player to apply English and other motion manipulations to the playing ball 20.

Cap 42 covers weight member 50 and threaded shaft portion 54 to provide game figure 10 with an aesthetically pleasing appearance.

The present invention thus provides an improved soccer game playing figure which provides a strengthened, balanced foot portion fabricated of a material that enables the user to impart English and other motion manipulations to a playing ball.

While the invention has been described with reference to its preferred embodiments, it will be understood by those skilled in the art that various changes may be made and equivalents may be substituted for elements thereof without departing from the true spirit and scope of the invention. In addition, many modifications may be made to adapt a particular situation or material to the teachings of the invention without departing from its essential teachings.

What is claimed is:

1. A table soccer game apparatus comprising a playing figure having a head portion, a body portion and a foot portion having front, rear and side surfaces, the improvement comprising a foot portion wherein said front, rear and side portions are fabricated from a flexible material, a first opening formed in said body portion and a second opening formed in said foot portion, said first and second openings being coaligned, and a support rod mounted in said coaligned openings.

2. The game of claim 1 wherein said flexible material comprises polyesopreme.

3. The game of claim 1 wherein said flexible material comprises polyeurathane.

4. The game of claim 1 wherein said flexible material comprises hard rubber.

5. The game of claim 1 further including a member having a head portion and a threaded shank portion, said threaded shank portion being inserted into a threaded opening formed in said body portion and into an actuation rod extending through said body portion.

6. The game of claim 1 wherein said rear surface of said foot portion is substantially flat and said front surface is radiused.

* * * * *